United States Patent [19]

Annovi

[11] Patent Number: 4,570,363

[45] Date of Patent: Feb. 18, 1986

[54] SKI BOOT WITH A NORMALIZED SOLE

[75] Inventor: Giuseppe Annovi, Montebelluna, Italy

[73] Assignee: Dolomite, S.p.A., Montebelluna, Italy

[21] Appl. No.: 559,365

[22] Filed: Dec. 8, 1983

Related U.S. Application Data

[63] Continuation-in-part of Ser. No. 306,386, Sep. 28, 1981, abandoned.

[30] Foreign Application Priority Data

May 13, 1983 [IT] Italy ..... 61940/83[U]

[51] Int. Cl.[4] ..... A43B 5/04; A43B 3/24

[52] U.S. Cl. ..... 36/117; 36/7.5; 36/15; 36/132

[58] Field of Search ..... 36/117–121, 36/132, 15, 100, 101, 7.5

[56] References Cited

U.S. PATENT DOCUMENTS

| | | | |
|---|---|---|---|
| 4,138,828 | 2/1979 | Kubelka | 36/121 |
| 4,261,114 | 4/1981 | Villetto | 36/120 |
| 4,294,025 | 10/1981 | Keller | 36/132 |
| 4,351,120 | 9/1982 | Dalebout | 36/117 |

FOREIGN PATENT DOCUMENTS

| | | | |
|---|---|---|---|
| 0085026 | 8/1983 | European Pat. Off. | 36/118 |
| 3004668 | 8/1981 | Fed. Rep. of Germany | 36/100 |

*Primary Examiner*—James Kee Chi

*Attorney, Agent, or Firm*—Kimmel, Crowell & Weaver

[57] ABSTRACT

A ski boot having a jointed lockable leg portion includes a sole suitable for walking on ice or snow. The boot has a normalized sole attachment compatible with most ski bindings and having at least one bottom opening for the discharge of ice or snow accumulating between the foot portion of the ski boot and the normalized sole. The ski boot and normalized sole have rear interlocking elements and front pressure-releasable locking parts.

6 Claims, 2 Drawing Figures

SKI BOOT WITH A NORMALIZED SOLE

CROSS-REFERENCE TO RELATED APPLICATION

This application is a continuation-in-part of prior copending application Ser. No. 06/306,386, filed Sept. 28, 1981, for Ski Boot with a Normalized Sole, now abandoned. This application also contains subject matter in common with copending application Ser. No. 625,965, filed Apr. 13, 1984, which was a continuation of application Ser. No. 306,386.

BACKGROUND OF THE INVENTION

The above prior application discloses a ski boot comfortable for regular walking on ice or snow and having an anti-slip sole, the boot being relatively lightweight. The boot contains an inner stuffing extending above the leg portion, and the boot has front closure means. A normalized sole attachment for the regular walking boot is provided, rendering it conformable to most ski bindings and having the customary front and rear projections. The normalized sole and the foot portion of the ski boot have interlocking elements at their rear ends and interengaging releasable fastening means near the toe of the boot. The upper surface of the normalized sole attachment has a profile complementary to the profile of the anti-slip sole of the walking boot.

The present invention improves upon the invention of the prior application in three significant ways. First, the boot is provided with a jointed leg portion which is articulated relative to the foot portion of the boot and having means to lock or immobilize the jointed leg portion in a desired position. Second, the normalized sole attachment is provided with at least one bottom opening for the discharge of ice accumulated thereunder. Third, the normalized sole attachment is locked to the foot portion of the boot by rear mutually engaging rigid elements by a forward pressure-releasable locking lever means.

Other features and advantages of the invention will become apparent to those skilled in the art during the course of the following description.

DETAILED DESCRIPTION

Figure 1:
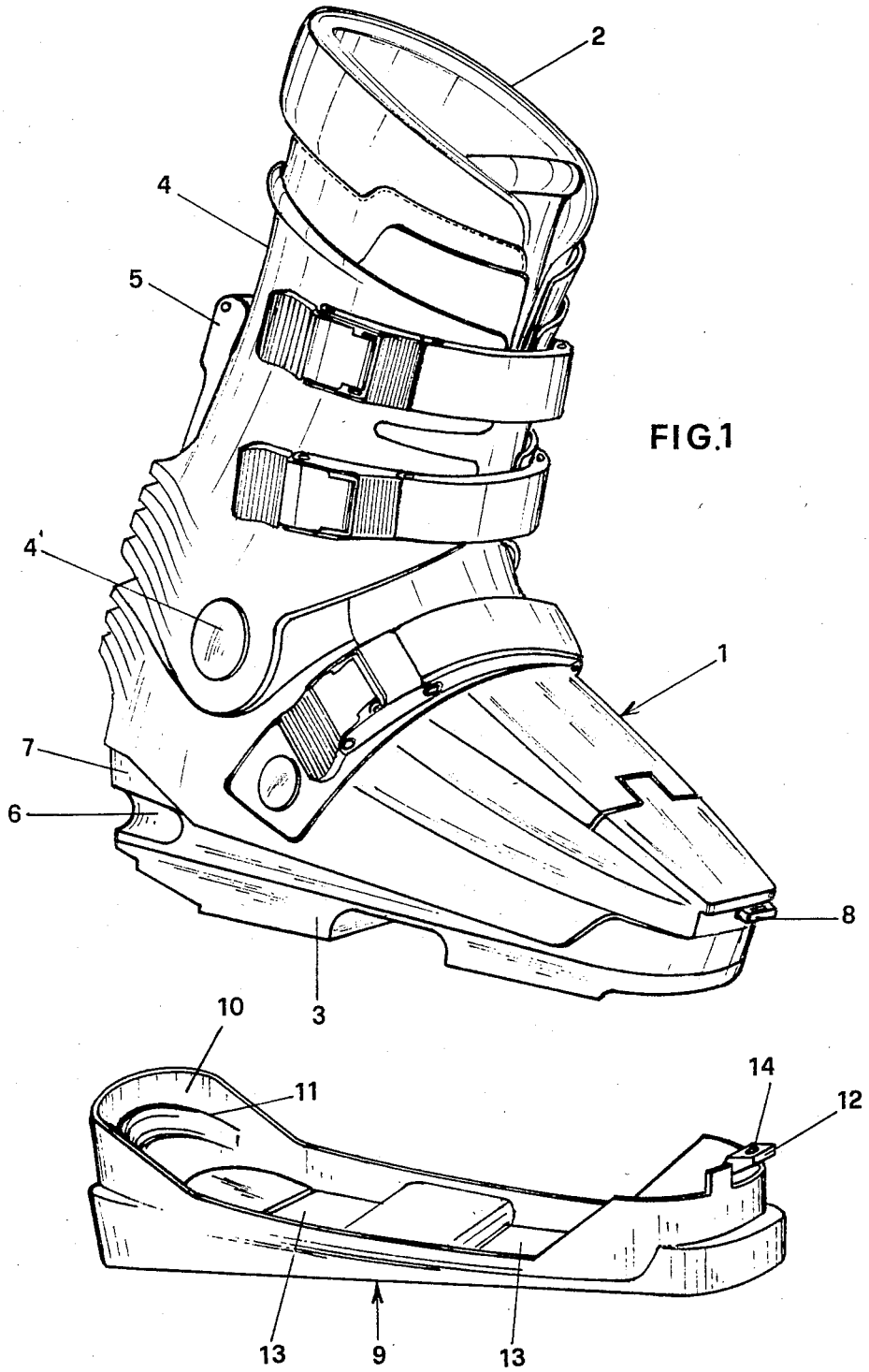
FIG. 1 is an exploded perspective view of a ski boot according to the present invention.
Figure 2:
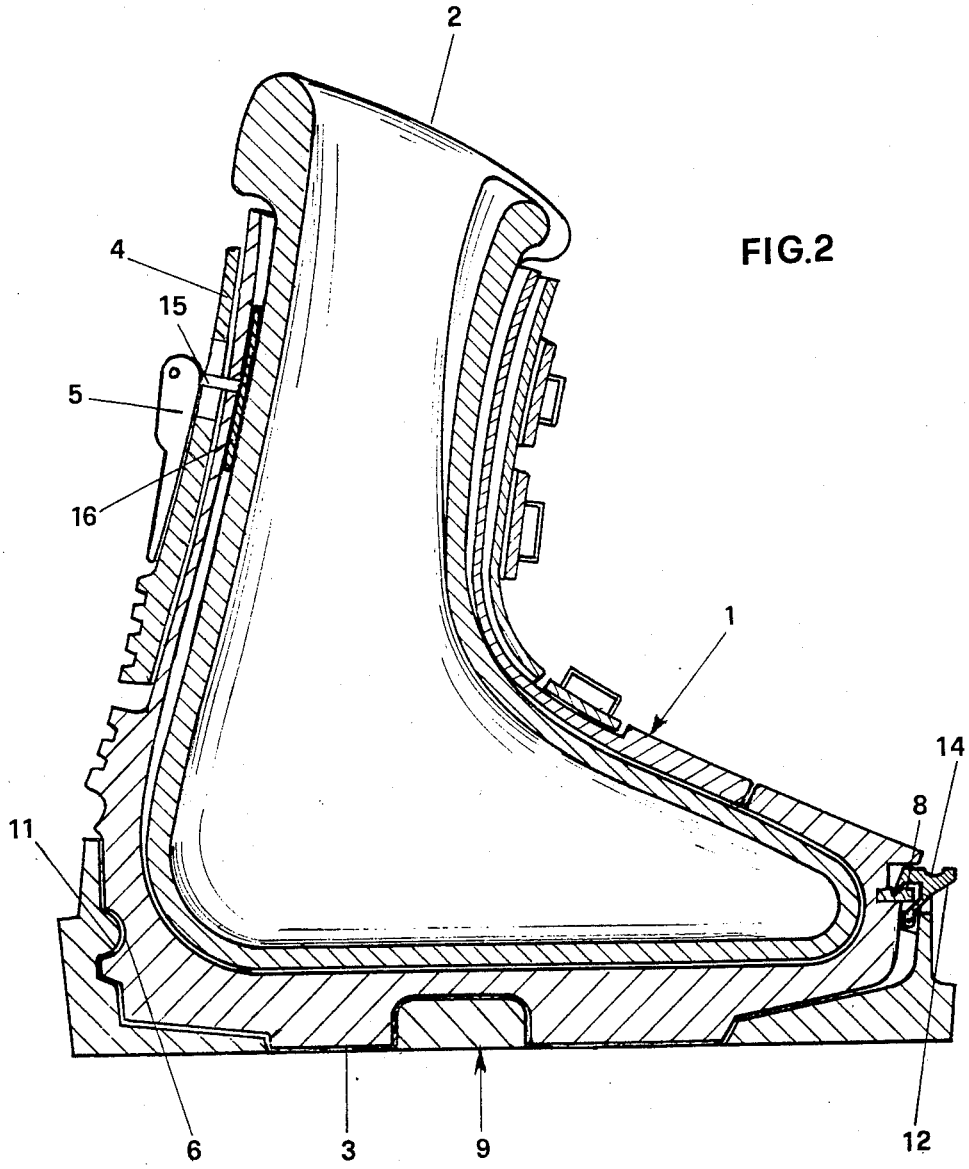
FIG. 2 is a central vertical section taken through the ski boot with the parts thereof assembled and locked.

Referring to the drawings in detail, wherein like numerals designate like parts, a ski boot formed of injection molded plastics is illustrated having an external foot portion 1, equipped with an inner stuffing 2 extending above the leg portion of the boot. The foot portion 1 includes a regular walking sole 3 without front and back projections to render the boot compatible with ski bindings. The foot portion 1 further includes transverse grooves forming an anti-slip tread suitable for walking on ice or snow.

On the top of the foot portion 1 of the boot, a leg portion 4 is jointed thereto as at 4'. The jointed leg portion 4 is provided with an eccentric locking lever 5 operable to lock the leg portion in a fixed position. The lever 5 is pivotally connected with an inwardly extending pin 15 connected with a pressing element or plate 16, positioned between the stuffing 2 and boot leg portion 4.

The ski boot foot portion 1 also is provided at its rear with a horizontal groove 6 extending across the entire heel 7, and at its front with a projection 8 adapted for spring engagement with a normalized sole attachment 9.

This normalized sole 9 is formed separately from the foot portion 1 and is shaped and sized and formed of material conforming to established rules pertaining to the adaptation of ski boots to ski bindings.

The normalized sole has an upstanding edge 10 extending around its perimeter and adapted to receive within it a complementary portion at the bottom of boot foot portion 1. At the rear of normalized sole 9, a horizontal rib 11 is formed complementary to the groove 6 in heel 7. At the front of the sole 9 and interiorly of the edge 10, a spring lever 12 is provided for locking engagement over the projection 8 to securely releasably lock the normalized sole 9 to the foot portion 1. Preferably, the lever 12 has a central upper recess 14 enabling the lever to be operated conveniently with the point of a ski pole or racket.

The normalized sole attachment 9 is provided in its bottom with spaced openings 13, which allow the discharge of snow accumulated under the foot portion 1 during walking.

With the normalized sole 9 removed, the boot can be used for regular walking, and is quite comfortable, secure and relatively lightweight. The comfort may be increased by releasing the lever 5 to its relaxed position, thereby allowing free articulation of the leg portion 4.

For skiing, the boot foot portion 1 is engaged in the normalized sole attachment 9, by first engaging the blocking rib 11 with the groove 6 and subsequently engaging the lever 12 over the projection 8. The eccentric lever 5 may then be operated to lock the leg portion 4 rigidly at the optimum angle for a particular skier.

After the sole attachment 9 is firmly in place on the boot, the latter is placed into a ski binding in the traditional way. In essence, the normalized sole 9 transforms the walking boot into a ski boot which is compatible with any ski binding, due to the forward and rear projections on the normalized sole.

After skiing, when the skier wishes to take off his skis, he can release the bindings and then release the lever 12 and slip the foot portion 1 from the sole 9. It is also possible to first release the lever 12 depressing it with the point of a ski pole, before releasing the ski binding, thus releasing the boot foot portion 1 from the normalized sole 9 which remains fixed to the ski.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A ski boot having a sole and foot portion constructed for comfortable walking when a wearer is not engaged in skiing, a normalized sole attachment separate from the ski boot and being of a size, shape and hardness to be engageable with substantially any ski binding but rendering normal walking during non-skiing activity very difficult and uncomfortable, and said ski boot having a leg portion articulated thereto, means to lock the leg portion substantially rigidly in a desired angular position while skiing, said normalized sole having at least a lower opening for the discharge of ice or snow accumulated under the foot portion during walking, rear interengaging means between the foot portion and the normalized sole, and pressure-releasable locking lever means between the foot portion and normalized sole substantially at the forward ends thereof.

2. A ski boot as defined in claim 1, wherein said means to lock the articulated leg portion comprises an eccentric lever on the leg portion, a pin connected with the eccentric lever, and a pressing element connected with the pin at the interior of the leg portion.

3. A ski boot as defined in claim 2, and said eccentric lever being disposed at the rear of the leg portion.

4. A ski boot as defined in claim 1, and wherein the rear interengaging means comprises a groove extending across the heel of the foot portion and a complementary rib formed on the rear and interior of the normalized sole.

5. A ski boot as defined in claim 1, wherein the front of said foot portion carries a projection engageable with said pressure-releasable locking lever.

6. A ski boot as defined in claim 5, and the pressure-releasable locking lever having an upper recess adapted to receive the tip of a ski pole of the like.

* * * * *